US006823909B1

(12) United States Patent
Marsteller

(10) Patent No.: US 6,823,909 B1
(45) Date of Patent: Nov. 30, 2004

(54) INTERCHANGEABLE ORGANIZER FOR CARRYING BAGS

(76) Inventor: Marilyn Anderson Marsteller, 3458 Observatory Pl., Cincinnati, OH (US) 45208

( * ) Notice: Subject to any disclaimer, the term of this patent is extended or adjusted under 35 U.S.C. 154(b) by 0 days.

(21) Appl. No.: 10/201,807

(22) Filed: Jul. 23, 2002

(51) Int. Cl.[7] ..... A45C 1/02
(52) U.S. Cl. ..... 150/113; 150/104; 190/108
(58) Field of Search ..... 150/104, 113, 150/100, 103, 106, 111, 148, 130, 125–127; 190/108–112; 383/13, 33, 35, 37

(56) References Cited

U.S. PATENT DOCUMENTS

| | | | | | |
|---|---|---|---|---|---|
| 3,061,057 | A | * | 10/1962 | Miller | 190/110 |
| 3,121,452 | A | * | 2/1964 | Hyman | 150/127 |
| 3,122,225 | A | * | 2/1964 | Ward | 190/108 |
| 3,137,335 | A | * | 6/1964 | Nash | 150/106 |
| 3,533,459 | A | * | 10/1970 | Ody | 150/113 |
| 3,830,348 | A | * | 8/1974 | Ohyama | 190/107 |
| D246,484 | S | * | 11/1977 | Wasserman | D87/5 G |
| 4,081,061 | A | * | 3/1978 | Tucker | 190/108 |
| 4,161,201 | A | | 7/1979 | Carp | |
| 4,811,769 | A | * | 3/1989 | Phares | 150/113 |
| 4,966,260 | A | * | 10/1990 | Young | 190/111 |
| 5,350,045 | A | | 9/1994 | Robertson | |
| 5,509,515 | A | * | 4/1996 | Guo | 190/110 |
| D393,366 | S | | 4/1998 | Kopel | |
| D403,863 | S | * | 1/1999 | Briganti | D3/318 |
| 5,865,233 | A | | 2/1999 | Roegner | |
| D408,146 | S | * | 4/1999 | Briganti | D3/318 |
| 5,944,155 | A | * | 8/1999 | Geary | 190/108 |
| 5,983,969 | A | * | 11/1999 | Morgan | 150/104 |
| 6,095,213 | A | | 8/2000 | Roegner | |
| 6,109,443 | A | * | 8/2000 | Dercole | 206/581 |
| 6,179,025 | B1 | | 1/2001 | Sutton | |
| 6,213,267 | B1 | * | 4/2001 | Miller | 190/108 |
| D460,622 | S | * | 7/2002 | Wong | D3/318 |

OTHER PUBLICATIONS

Levenger, Tools for Serious Readers, Early Summer 2002.

* cited by examiner

*Primary Examiner*—Lien Ngo
(74) *Attorney, Agent, or Firm*—Graydon Head & Ritchey LLP

(57) ABSTRACT

A removable insert for bags holds and organizes personal articles. A first insert module comprises a closed base, an open top, side walls and pocket walls extending between the side walls. The pocket walls and side walls of the first insert module define a plurality of vertical pockets. A second insert module is separable from the first insert module. The second insert module comprises a closed base, an open top, side walls and pocket walls extending between the side walls. The pocket walls and side walls of the second insert module define a plurality of vertical pockets. An attachment mechanism selectively attaches and detaches the first and second insert modules to one another, wherein when attached the first and second insert modules are adjacent one another and the bases of the first and second insert modules are coplanar.

19 Claims, 6 Drawing Sheets

INTERCHANGEABLE ORGANIZER FOR CARRYING BAGS

FIELD OF THE INVENTION

The present invention relates in general to carrying bags, and will be illustrated in the context of a removable insert for carrying and organizing personal articles.

BACKGROUND

An ongoing challenge in our modern "on the go" society is organizing one's personal articles. This is especially true in the case of organizing articles that are placed in carrying bags. Consider for instance the multitude of personal articles that are typically carried in a woman's purse. It is not unusual for any given woman to have a dozen or more discrete personal articles placed in a purse. Unfortunately, most purses are little more than unorganized "black holes" in which the articles are thrown helter-skelter, making the task of locating an article a time consuming and often frustrating affair. Moreover, in situations where one needs to change carrying bags, the personal articles must be individually transferred between bags. The present invention offers a novel and unique solution to organize articles in carrying bags. While a variety of organizational products are available none do so in the same manner as or offer the benefits of the present invention.

SUMMARY

One example of the invention is a removable insert for a carrying bag. A first portion has a top, a bottom and side walls, with one or more vertical pockets between the side walls that are open at the top and closed at the bottom. A second portion has a top, a bottom and side walls, with one or more vertical pockets between the side walls that are open at the top and closed at the bottom. The second portion is adjacent the first portion, the bottoms of the first and second portions are aligned, and the side walls of the second portion are lower than the side walls of the first portion. An attachment mechanism, such as a zipper, connects the first and second portions and is configured to selectively attach and detach the first and second portions.

In another example, a removable insert for carrying bags holds and organizes personal articles. A first insert module comprises a closed base, an open top, side walls and one or more pocket walls extending between the side walls. The pocket walls and side walls of the first insert module define two or more vertical pockets, and the side walls are sufficiently stiff to bias the pockets open at the top. A second insert module is separable from the first insert module. The second insert module comprises a closed base, an open top, side walls and one or more pocket walls extending between the side walls. The pocket walls and side walls of the second insert module define two or more vertical pockets, the side walls being sufficiently stiff to bias the pockets open at the top and the side walls being shorter in height than the side walls of the first insert module. An attachment mechanism selectively attaches and detaches the first and second insert modules to one another, wherein when attached the first and second insert modules are adjacent one another and the bases of the first and second insert modules are coplanar.

In yet another example, a removable insert holds and organizes personal articles in carrying bags. A first insert module comprises a closed base, an open top, stiff side walls, and means for defining a plurality of pockets within the side walls. A second insert module is separable from and shorter than the first insert module. The second insert module comprises a closed base, an open top, stiff side walls, and means for defining a plurality of pockets within the side walls. A means selectively attaches and detaches the first and second insert modules to one another.

Still other examples, features, aspects, embodiments, and advantages of the invention will become apparent to those skilled in the art from the following description, which is by way of illustration, one of the best modes contemplated for carrying out the invention. As will be realized, the invention is capable of other different and obvious aspects, all without departing from the invention. Accordingly, the drawings and descriptions should be regarded as illustrative in nature and not restrictive.

BRIEF DESCRIPTION OF THE DRAWINGS

While the specification concludes with claims which particularly point out and distinctly claim the invention, it is believed the present invention will be better understood from the following description taken in conjunction with the accompanying drawings, in which like reference numerals identify the same elements and in which:

DETAILED DESCRIPTION

Figure 1:
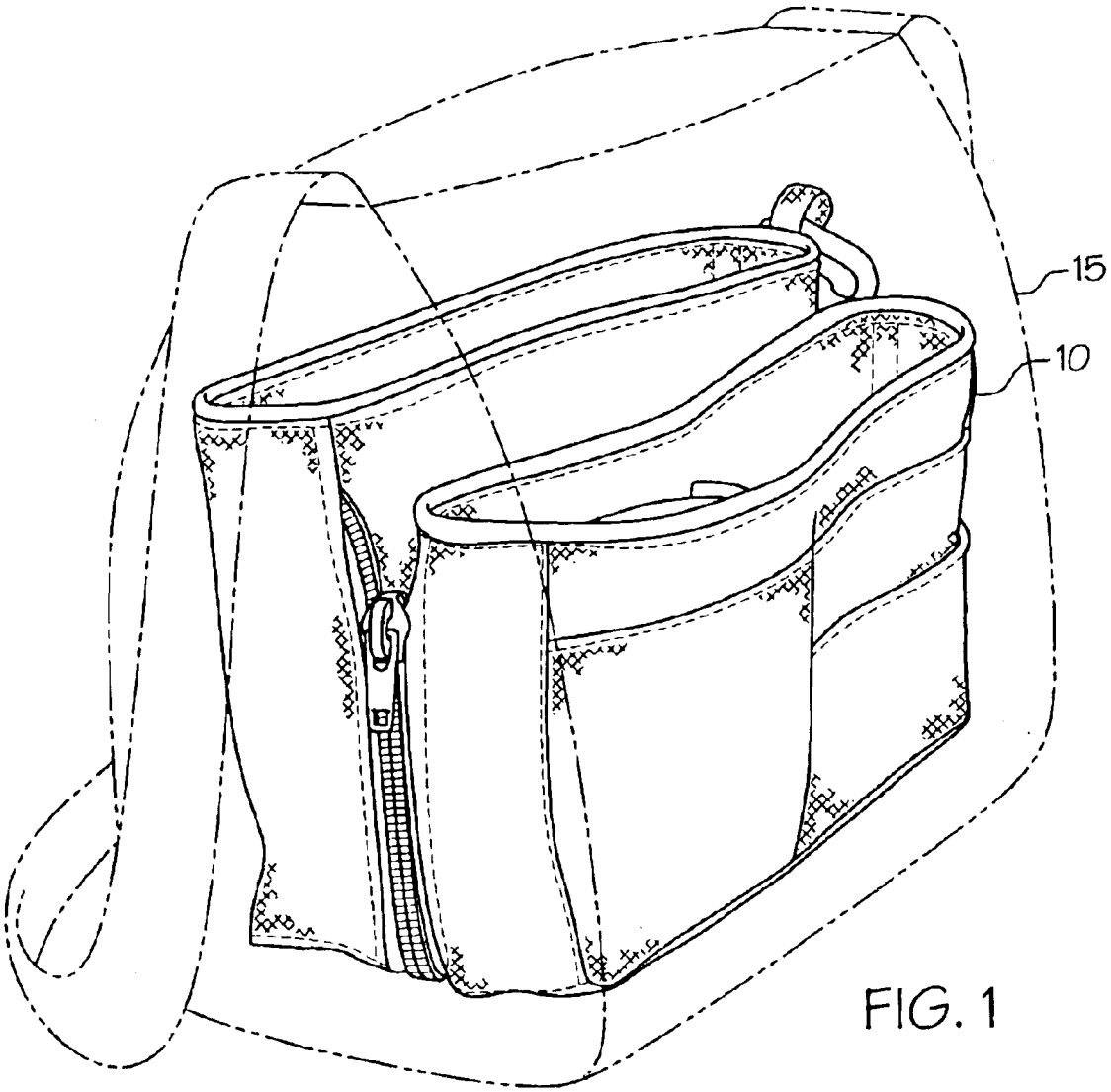
FIG. 1 illustrates an example of a bag insert placed in a purse.

FIG. 1 illustrates one example of a removable insert 10 for a carrying bag 15. Various articles can be placed and organized in the insert 10. The number and type of articles that can be placed in the insert are virtually unlimited. Some examples of typical articles include wallets, glasses, cell phones, pens, cards (e.g. credit cards, security cards, driver's licenses), keys, paper pads, passports, make-up, key cards, pagers, personal electronic assistants (PDA's), MP3 players and the like. As shown in this example, the carrying bag 15 is a purse, however, the insert 10 can be used a numerous other bags, including brief cases, back packs, fanny packs, diaper bags, sports bags, travel totes, beach bags, flight bags and the like. The insert 10 is readily removable from the bag 15, so one could simply remove the insert along with its contents and place it into another bag. As such, the same insert 10 could be used with a number of different bags. For instance, the various personal articles that a woman generally carries in a purse could be organized in the insert 10. On the occasions when the woman decides to change purses, she could simply move the insert 10 to the new purse. Alternatively, the same woman could move the insert from her purse to her briefcase, thus eliminating the need to carry two bags. Accordingly, transitioning between bags is very simple and the personal articles will remain organized and in a familiar pattern.

Figure 2:
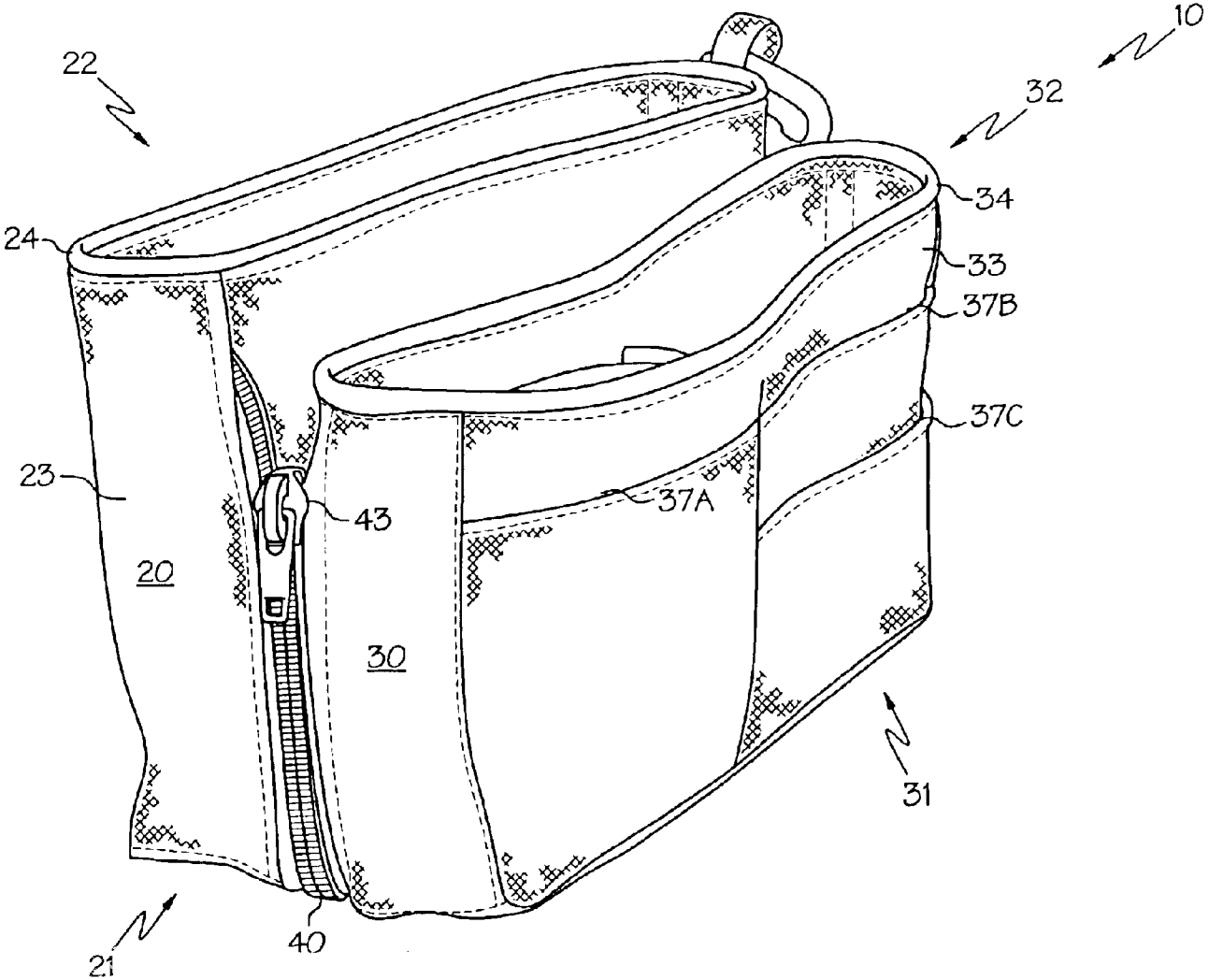
FIG. 2 is an oblique view of an example of a bag insert.

FIG. 2 illustrates an example of an insert 10. The insert 10 comprises two modules 20, 30. The first module 20 has an open top 22, a closed bottom 21 and side walls 23. Similarly, the second module 30 has an open top 32, a closed bottom 31 and side walls 33. While the insert 10 of the present example has two modules each with open tops, it is contemplated that a closeable flap could be added to cover one or both of the tops of the modules. An open top, however, provides the benefit of ease of access to articles placed in the insert 10 when positioned in a bag. In the present example, the insert 10 is made from a synthetic microfiber fabric, however, the insert 10 can be constructed from numerous materials, such as leather, hard or soft plastic, various fabrics and the like. In the present example, the side walls 33 of the second module 30 are lower than the side walls 23 of the first module 20, however, it is contemplative that the height of the two modules can be the same. Further, the present example illustrates only two modules, but three or more modules could also be used.

The two modules 20, 30 are a generally elongated shape and adjacent one another along their lengths. As shown here the two modules 20, 30 are generally the same length, however, the modules with staggered lengths could also be employed. The bottoms 21, 31 are generally flat and aligned with one another in the same horizontal plane. By providing a flat and co-planar base, the insert 10 is self-standing (i.e. capable of supporting itself and maintaining its vertical alignment). As such, the insert 10 can, independently stand without tipping over and spilling its contents. Stiffening can be added to the base and/or side walls to further facilitate the self-standing feature. While a co-planar base is shown here, the bottoms 21, 31 do not necessarily need to be flat nor aligned with one another.

The attachment mechanism 40 is configured to selectively attach and detach the two modules 20, 30. In the present example, the attachment mechanism 40 is a zipper. By pulling the slider 43 and unzipping the zipper 40, the two modules 20, 30 can be totally separated from one another. Likewise, the two modules can be reattached by zipping the zipper 40. Beyond a zipper, other attachment mechanisms could also be employed, such as Velcro, snaps, buttons, magnets, straps and the like. While a detachable feature offers numerous advantages, in some application it may be desirable that the two modules 20, 30 be permanently attached to one another trough stitching or other suitable means.

The first module 20 has one or more vertically aligned pockets positioned between the side walls 23 that are open at the top 22 and closed at the bottom 21. Likewise, the second module has one or more vertically aligned pockets between the side walls 33 that are open at the top 32 and closed at the bottom 31. As shown here, the vertical pockets are all open at the top and closed at the bottom, however, its is contemplated that one or more of the vertical pockets could be closed at the top, such as through a snap or flap. The second module 30 further includes side pockets 37A–C located on the outer surface of the side walls 33.

In the present example, the side walls 23, 33 are generally pliant but are sufficiently stiff to bias the vertical pockets to remain open at the top 22, 32, respectively. This biasing feature tends to keep the vertical pockets open when the insert 10 is placed in a bag thus facilitating ease of access to the pockets. As shown here, the modules 20, 30 include piping 24, 34 positioned around the periphery of the open tops 22, 32 that contributes to this stiffening of the side walls. Preferably the piping 24, 34 is a contrasting color to that of the side walls 23, 33, respectively, thus providing the benefit of visually highlighting the openings of the modules to make the pockets more visible in a low light environment. In lieu of or in addition to the piping, the biasing feature could be achieved through numerous other mechanisms such as the intrinsic stiffness of the material used to form the side walls, adding inserts in the side walls, adding wire within the side walls or piping, and the like. While pliant side walls 23, 33 may be desirable in many applications, the side walls 23, 33 could also be a relatively stiff or hard material, such as hardened leather.

Figure 3:
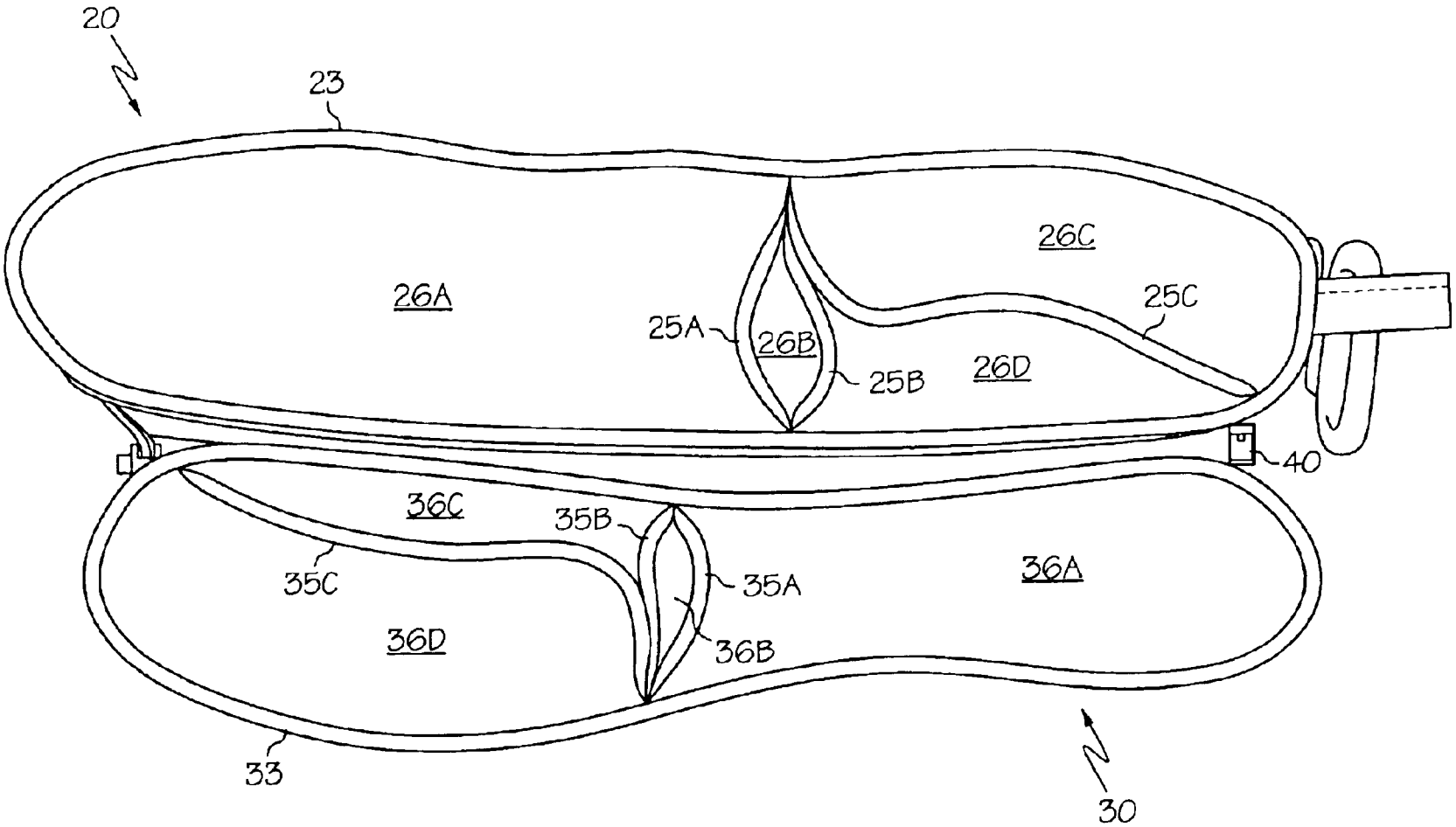
FIG. 3 is a top view of an example of a bag insert.

FIG. 3 illustrates examples of vertical pocket configurations for the two modules 20, 30. As will be readily appreciated by one with ordinary skill in the art, numerous alternative pocket configurations can be selected for any given application. As shown here, the first module 20 includes four pockets 26A–D defined by the side walls 23 and pocket walls 25A–C. Similarly, the second module 30 shown here includes four pockets 36A–D defined by the side walls 33 and pocket walls 35A–C. In the present example, each module 20, 30 includes a large pocket 26A, 36A, respectively, covering at least half of the module, with a plurality of smaller pockets 26B–D, 36B–D covering the remainder of the module. While a selection of multiple pockets may be desirable in many cases, a module could have no pocket walls and have only one large pocket entirely defined by the side walls.

Figure 4:
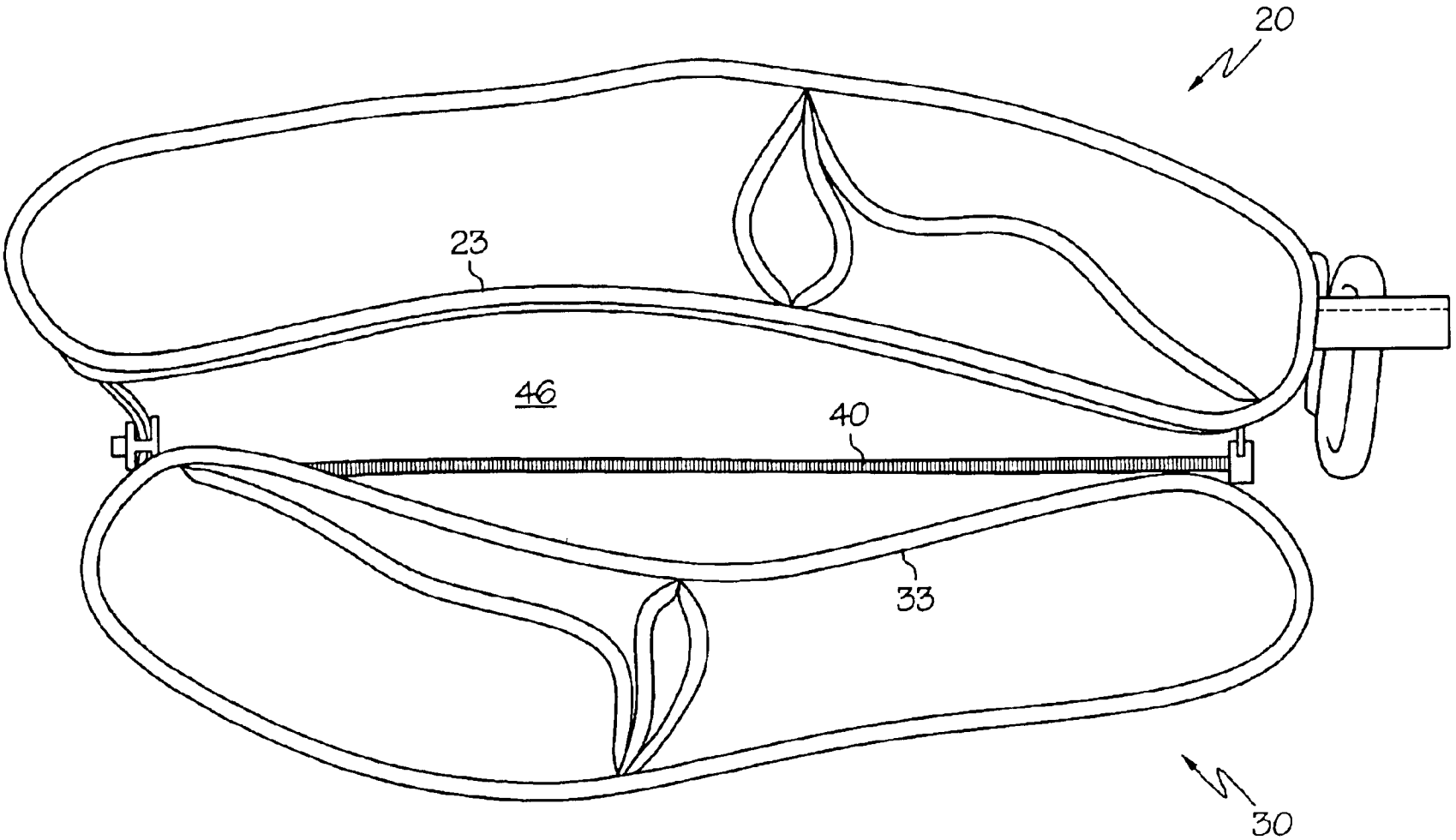
FIG. 4 is a top view of an example of a bag insert.

FIG. 4 shows the modules 20, 30 pulled apart but still connected to one another to illustrate an additional large pocket 46 located between the first and second modules 20, 30 and defined by the zipper 40 and the side walls 23, 33.

Figure 5:
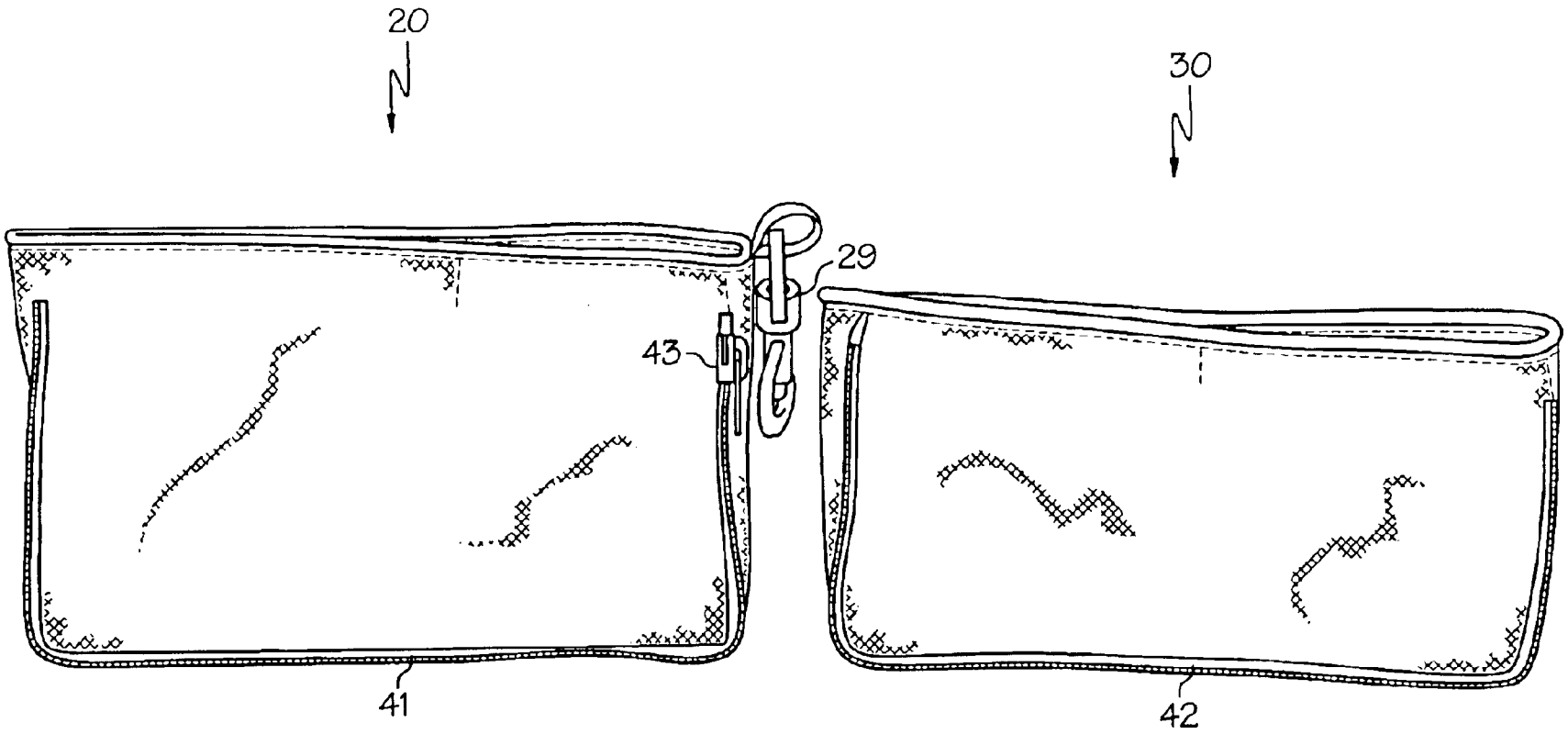
FIG. 5 is a side view of an example of a bag insert.
Figure 7:
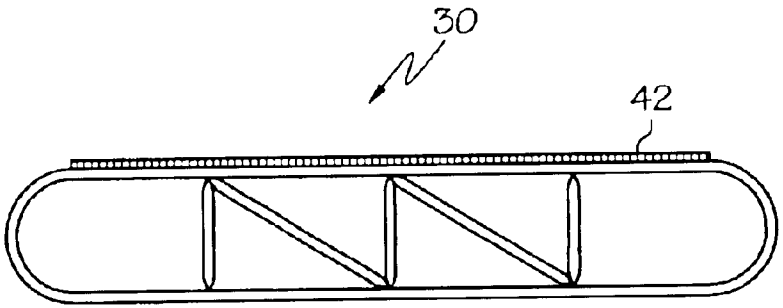
FIG. 7 illustrates an alternative pocket arrangement for a bag insert.
Figure 9:
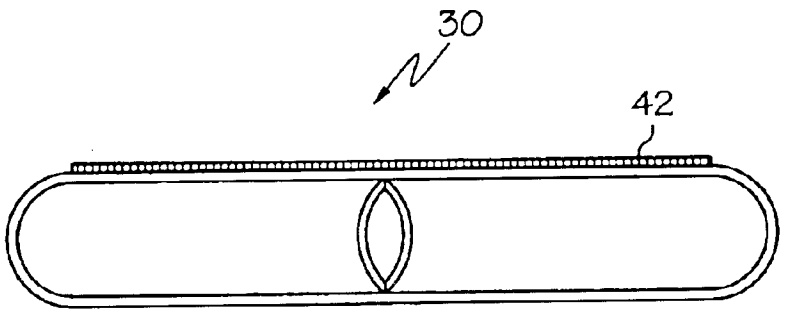
FIG. 9 illustrates an alternative pocket arrangement for a bag insert.
Figure 6:
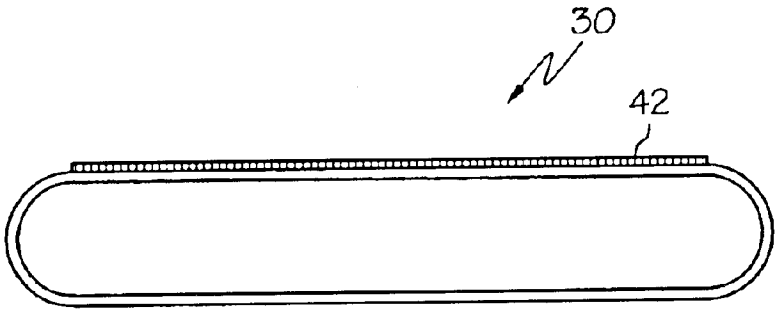
FIG. 6 illustrates an alternative pocket arrangement for a bag insert.
Figure 8:
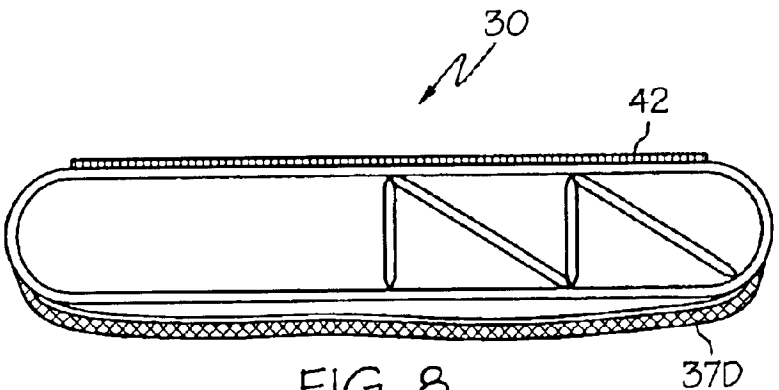
FIG. 8 illustrates an alternative pocket arrangement for a bag insert.

FIG. 5 illustrates a hook 29 upon which personal articles can be hung, which is especially well suited for key rings. Alternatively, the hook 29 could be used to fasten the insert to something so it would not be lost or for hanging the insert. FIG. 5 also illustrates the two modules 20, 30 detached from one another. The zipper 40 includes two mating zipper halves 41, 42, with the slider 43 remaining attached to zipper half 41. In such a configuration, the first module 20 can be considered the master module, and the second module 30 can be considered the supplemental module. The supplemental module 30 could be selected from a group of different supplemental modules each having a different configuration of pockets. FIGS. 6–9 illustrate several examples of such supplemental modules 30. Each supplemental module 30 includes a zipper half 42 that can be attached to the other zipper half 41, but each module 30 has a different pocket configuration. In addition, the supplemental module 30 shown in FIG. 8 includes a mesh side pocket 37D located on the outside of the side wall. Accordingly, one could select a supplemental module 30 to fit their particular organizational requirements and connect it to the master module 20 to make a customized insert.

As will be readily apparent to one with ordinary skill in the art, the bag insert can be marketed in a number of ways to consumers. An insert made with premium materials and with a full range of features can be sold to an upper end market, while inserts with lower quality materials and fewer features can be sold in a more economy oriented market. Further, the insert can be marketed as an entire system for organizing personal articles. For instance, the master module 20 can be sold as a base article (with or without a basic supplemental module 30), and the consumer could buy one or more supplemental modules 30 based on their specific organizational preferences. In addition a number of matching accessories can also be sold as part of a line of products, such as wallets, change holders, card holders, key holders, make-up bags check book covers, accessory bags and the like.

Having shown and described various embodiments of the present invention, further adaptations of the insert described herein can be accomplished by appropriate modifications by one of ordinary skill in the art without departing from the scope of the present invention. Several of such potential modifications have been mentioned, and others will be apparent to those skilled in the art. Accordingly, the scope of the present invention should be considered in terms of the following claims and is understood not to be limited to the details of structure and operation shown and described in the specification and drawings.

What is claimed is:

1. A removable self-standing insert for a carrying bag, the insert comprising:

a) a first portion having a top, a bottom and side walls, said first portion comprising one or more vertical pockets between the side walls that are open at the top and closed at the bottom;

b) a second portion having a top, a bottom and side walls, said second portion comprising one or more vertical pockets between the side walls that are open at the top and closed at the bottom, said second portion is adjacent the first portion and the bottoms of the first and second portions are aligned and the side walls of the second portion are lower than the side walls of the first portion;

c) an attachment mechanism connecting the first and second portions, said attachment mechanism being configured to selectively attach and detach the first and second portions; and d) a pocket open at the top and closed at the bottom located between the first and second portions and defined by the attachment mechanism and the side walls of the first and second portions.

2. The insert of claim 1, wherein the carrying bag is a purse.

3. The insert of claim 1, wherein the side walls are stiff and bias the pockets to remain open at the top.

4. The insert of claim 1, wherein the attachment mechanism is a zipper.

5. The insert of claim 1, wherein the second portion is selected from a plurality of different second portions having different pocket configurations.

6. The insert of claim 1, further comprising a plurality of matching accessories.

7. The insert of claim 1, further comprising one or more pockets on the second portion located outside the side walls.

8. The insert of claim 1, wherein the pockets of the first portion comprises a large pocket covering at least half of the first portion and a plurality of small pockets covering the remainder of the first portion.

9. A removable self-standing insert for carrying bags to hold and organize personal articles, the insert comprising:

a) a first insert module comprising a closed base, an open top, side walls and one or more pocket walls extending between the side walls, said pocket walls and side walls defining two or more vertical pockets, the side walls being sufficiently stiff to bias the pockets open at the top;

b) a second insert module separable from the first insert module, said second insert module comprising a closed base, an open top, side walls and one or more pocket walls extending between the side walls of the second insert module, said pocket walls and side walls defining two or more vertical pockets, the side walls being sufficiently stiff to bias the pockets open at the top and the side walls of the second insert module, being shorter in height than the side walls of the first insert module;

c) a zipper for selectively attaching and detaching the first and second insert modules to one another, wherein when attached the first and second insert modules are adjacent one another and the bases of the first and second insert modules are coplanar d) a pocket open at the top located between the first and second insert modules and defined by the zipper and the side walls of the first and second insert modules.

10. The insert of claim 9, wherein the bases of the first and second insert modules are generally flat and horizontal.

11. The insert of claim 10, wherein the bases of the first and second insert modules are a generally elongated shape.

12. The insert of claim 11, wherein the first and second insert modules are adjacent one another along the lengths of the bases.

13. The insert of claim 11, wherein the bases of the first and second insert modules are the same length.

14. The insert of claim 10, wherein the side walls of the first and second insert modules are connected to and extend vertically from the respective bases.

15. The insert of claim 9, further comprising piping along the top edge of the side walls of the first and second insert modules that contribute to the stiffening of the side walls.

16. The insert of claim 15, wherein the piping and side walls are contrasting colors.

17. The insert of claim 9, further comprising a plurality of second insert modules each having different configuration of pockets, wherein one of said plurality of second insert modules is selected and attached to the first insert module using the attachment mechanism.

18. The insert of claim 9, wherein the insert does not have a closure of flap that obstructs the open tops of the first and second insert modules.

19. An removable insert for holding and organizing personal articles in a carrying bag, the insert comprising:

a) a first insert module comprising a closed base, an open top, stiff side walls, and means for defining a plurality of pockets within the side walls;

b) a second insert module separable from and shorter than the first insert module, said second insert module comprising a closed base, an open top, stiff side walls, and means for defining a plurality of pockets within the side walls;

c) a means for selectively attaching and detaching the first and second insert modules to one another; and d) a pocket open at the top and closed at the bottom located between the first and second insert modules and defined by the attachment means and the side walls of the first and second insert modules.

* * * * *